US011527837B2

(12) United States Patent
Boyes

(10) Patent No.: US 11,527,837 B2
(45) Date of Patent: Dec. 13, 2022

(54) DUAL POLARISED OMNIDIRECTIONAL ANTENNA APPARATUS

(71) Applicant: THE SECRETARY OF STATE FOR DEFENCE, Salisbury (GB)

(72) Inventor: Stephen John Boyes, Salisbury (GB)

(73) Assignee: The Secretary of State for Defence, Salisbury (GB)

( * ) Notice: Subject to any disclaimer, the term of this patent is extended or adjusted under 35 U.S.C. 154(b) by 0 days.

(21) Appl. No.: 16/975,773

(22) PCT Filed: Feb. 8, 2019

(86) PCT No.: PCT/GB2019/000023
§ 371 (c)(1),
(2) Date: Aug. 26, 2020

(87) PCT Pub. No.: WO2019/166750
PCT Pub. Date: Sep. 6, 2019

(65) Prior Publication Data

US 2020/0412023 A1 Dec. 31, 2020

(30) Foreign Application Priority Data

Mar. 2, 2018 (GB) ..... 1803433

(51) Int. Cl.
*H01Q 21/24* (2006.01)
*H01Q 1/24* (2006.01)
(Continued)

(52) U.S. Cl.
CPC ..... *H01Q 21/24* (2013.01); *H01Q 1/246* (2013.01); *H01Q 21/205* (2013.01); *H01Q 25/001* (2013.01)

(58) Field of Classification Search
CPC ..... H01Q 21/06; H01Q 21/20; H01Q 21/205; H01Q 21/24; H01Q 1/27; H01Q 1/32
See application file for complete search history.

(56) References Cited

U.S. PATENT DOCUMENTS 6,218,989 B1 4/2001 Schneider et al.
6,295,035 B1 * 9/2001 Holzheimer ..... H01Q 3/40 343/797
(Continued)

FOREIGN PATENT DOCUMENTS

CN 2727987 Y 9/2005
CN 108417994 A 8/2018
(Continued)

OTHER PUBLICATIONS

United Kingdom Patent Application No. GB1803433.0, Search Report dated Aug. 14, 2018, 4 pages.
(Continued)

*Primary Examiner* — Jason Crawford
(74) *Attorney, Agent, or Firm* — Kilpatrick Townsend & Stockton LLP

(57) ABSTRACT

A dual polarised omnidirectional antenna apparatus (20) capable of operating in transmit and receive, comprising at least two dual polarised directional antennas (21) configured to be mountable in a substantially equi-spaced distributed array around and pointing away from a platform, wherein the antenna apparatus (20) is configured such that, when operated in transmit, the dual polarised directional antennas operate in phase with each other to deliver a combined omnidirectional, dual polarised, performance. This increases operational bandwidth and mitigates interference effects in communications applications.

21 Claims, 3 Drawing Sheets

(51) Int. Cl.
*H01Q 21/20* (2006.01)
*H01Q 25/00* (2006.01)

(56) References Cited

U.S. PATENT DOCUMENTS

| | | | | |
|---|---|---|---|---|
| 6,448,933 | B1 | 9/2002 | Hill et al. | |
| 9,800,396 | B1 * | 10/2017 | Kuo | H01Q 3/46 |
| 10,069,214 | B1 * | 9/2018 | Hooper | H01Q 21/205 |
| 10,418,723 | B1 * | 9/2019 | Livadaru | H01Q 1/38 |
| 10,581,147 | B1 * | 3/2020 | West | H01Q 21/24 |
| 2002/0085643 | A1 | 7/2002 | Kitchener et al. | |
| 2004/0077379 | A1 * | 4/2004 | Smith | H04W 16/10 455/562.1 |
| 2010/0079347 | A1 * | 4/2010 | Hayes | H01Q 3/2682 343/705 |
| 2013/0265197 | A1 * | 10/2013 | Jones | H01Q 25/00 342/373 |
| 2014/0035781 | A1 | 2/2014 | Holzheimer | |
| 2014/0036777 | A1 * | 2/2014 | Kokkinos | H01Q 5/50 370/328 |
| 2014/0197998 | A1 | 7/2014 | Govindasamy et al. | |
| 2015/0380815 | A1 * | 12/2015 | Boutayeb | H01Q 21/20 343/777 |
| 2016/0149634 | A1 | 5/2016 | Kalkunte et al. | |
| 2017/0271764 | A1 | 9/2017 | Gabriel et al. | |
| 2017/0318589 | A1 * | 11/2017 | Negus | H01Q 21/205 |
| 2018/0151947 | A1 | 5/2018 | Apostolos et al. | |
| 2018/0198513 | A1 * | 7/2018 | Petersson | H04B 7/043 |
| 2018/0375221 | A1 * | 12/2018 | Petersson | H01Q 21/245 |
| 2019/0058248 | A1 * | 2/2019 | Kopelman | H01Q 1/24 |
| 2019/0074871 | A1 * | 3/2019 | Petersson | H01Q 3/40 |
| 2020/0303831 | A1 * | 9/2020 | Li | H01Q 21/0025 |
| 2020/0412023 | A1 * | 12/2020 | Boyes | H01Q 21/205 |
| 2022/0029309 | A1 * | 1/2022 | Boyes | H01Q 9/285 |
| 2022/0263234 | A1 * | 8/2022 | Boyes | H01Q 21/205 |

FOREIGN PATENT DOCUMENTS

| | | | |
|---|---|---|---|
| GB | 2393856 | A | 4/2004 |
| GB | 2521910 | A | 7/2015 |
| GB | 2539327 | A | 12/2016 |
| WO | 2014086452 | A1 | 6/2014 |

OTHER PUBLICATIONS

International Patent Application No. PCT/GB2019/000023, International Search Report and Written Opinion dated May 7, 2019, 12 pages.
United Kingdom Patent Application No. GB1902185.6, Combined Search and Examination Report dated Jun. 19, 2019, 7 pages.
United Kingdom Patent Application No. GB1902185.6, Examination Report dated May 1, 2020, 1 pages.
International Patent Application No. PCT/GB2019/000023, International Preliminary Report on Patentability dated Sep. 17, 2020, 9 pages.

* cited by examiner

DUAL POLARISED OMNIDIRECTIONAL ANTENNA APPARATUS

TECHNICAL FIELD OF THE INVENTION

This invention relates to the field of omnidirectional antennas, in particular to omnidirectional antennas providing dual polarisation.

BACKGROUND TO THE INVENTION

Antennas are used for transmitting and receiving signals in various wireless applications. For instance antennas are widely used for communications, search and rescue, security and other military applications. Antennas are not only standalone devices, but can also be integrated into many different types of products ranging from antennas integrated as body wearable devices, antennas integrated into handsets/mobile personal digital assistants (PDAs) and vehicle/platform mounted antennas with associated systems. These different applications will have their own performance requirements that include, but are not limited to, weight, compactness, ergonomics, ruggedness and power consumption.

Omnidirectional antennas are used in many communications applications, in particular in applications where the line of sight between a transmitter and receiver is unknown. This has conventionally been achieved using monopole or dipole 'whip' type antennas, although such antennas are prone to snagging and not well suited to space constrained applications. Furthermore there is an ongoing demand for increases in antenna efficiency and operating bandwidth, in order to allow for higher data transfer rates and mitigation of multipath interference effects. Conventional omnidirectional antennas are limited in respect of their ability to cater for such improvements.

Therefore it is an aim of the present invention to provide an omnidirectional antenna apparatus that mitigates these issues.

SUMMARY OF THE INVENTION

According to a first aspect of the invention there is provided a dual polarised omnidirectional antenna apparatus capable of operating in transmit and receive, comprising at least two dual polarised directional antennas configured to be mountable in a substantially equi-spaced distributed array around and pointing away from a platform, wherein the antenna apparatus is configured such that, when operated in transmit, the dual polarised directional antennas operate in phase with each other to deliver a combined omnidirectional, dual polarised performance. This provides increased gain in comparison to single monopole or dipole omnidirectional antennas, owing to the directionality of each antenna. The antenna apparatus also increases available bandwidth and mitigates interference by providing two polarisations of transmission.

In preferred embodiments, the dual polarised omnidirectional antenna apparatus is further configured such that when operated in receive the dual polarised antennas operate in phase with each other to deliver a combined omnidirectional, dual polarised, performance. This provides increased gain, available bandwidth, and mitigation of interference effects, when operating in receive.

An antenna is suitable for transmitting or receiving signals using electromagnetic radiation, which may be at radio frequencies. An omnidirectional antenna apparatus is an antenna apparatus that provides a substantially uniform gain over 360° in for instance, azimuth. An omnidirectional performance can be a requirement in some applications of communications antennas such as search and rescue and some military applications. Traditionally this is achieved through use of conventional single element omnidirectional antennas such as monopole or dipole antennas. However omnidirectional performance can also be achieved through use of multiple directional antennas arranged appropriately as an antenna apparatus, as provided in GB2539327. Such a configuration can provide an improved power delivery mechanism.

The dual polarised directional antennas operate collectively to send (transmit) or receive a signal. The antennas collectively provide consistent panoramic coverage over 360°. To achieve such a performance the radiation patterns of each antenna must be configured appropriately. The consistent panoramic coverage may be continuously present with time. The consistent panoramic coverage is provided for two orthogonal polarisations, enabled by the dual polarised directional antennas of the invention. For example, in any azimuthal direction from the platform, there is overlapping vertical and horizontal polarised performance.

A directional antenna is an antenna that has increased performance (higher gain) in a particular direction. This is in contrast to omnidirectional antennas that radiate substantially uniformly in azimuth about the antenna. Directional antennas are useful in point to point communications where relatively higher gain is required along a particular sight line and transmission or receive performance in other directions is less important. The radiation pattern of a directional antenna has a dependency on frequency of operation. For instance the beam width of a particular directional antenna may be narrower at certain frequencies than at others. Directional antennas include cavity backed omnidirectional antennas and planar type antennas (typically comprising a radiating top plate and a ground plane) such as patch or PIFA antennas. Planar type antennas offer a reduced profile in comparison to other directional antennas and are relatively cost-effective to manufacture.

Increased gain, owing to the use of directional antennas, means less power is required at each directional antenna to achieve a given receive power at a receiver along a sightline (compared to a conventional omnidirectional whip antenna, for instance). This means size and weight of auxiliary components (such as power supplies) can be reduced—particularly important considerations where such an omnidirectional antenna apparatus, is to be body wearable or mounted upon a vehicle. Furthermore, the use of directional antennas means that greater radiated powers do not result in a significant increase in radiation hazard to a platform mounting the omnidirectional antenna apparatus (owing to the radiation being directed away from the platform).

The demand for increased antenna bandwidth has been driven by the mobile telecommunications sector. In particular, Multiple Input Multiple Output (MIMO) techniques have provided a plurality of 'channels' on a single antenna for communication.

However this has led to antennas that are bespoke to mobile handsets (in terms of power requirement, spatial size, and frequencies of operation). Other applications of communications antennas, in particular platform (body, vehicle) mounted applications, have not experienced similar levels of development.

The dual polarised directional antennas can transmit or receive using two orthogonal polarisations (for instance horizontal and vertical) simultaneously. The use of two orthogonal polarisations simultaneously is particularly advantageous in overcoming signal fading owing to multipath interference effects, and when a transmitted electromagnetic signal experiences a change in polarisation owing to reflections off surfaces or propagation through certain media. A dual polarisation capability also provides an effective de-correlation capability allowing two simultaneous channels for data transfer. Each dual polarised antenna may comprise two planar antenna elements rotated to be spatially orthogonal to each other, for instance, to achieve two linear polarisations. Alternatively a circularly polarised antenna element may be used (which will comprise vertically and horizontally polarised components), although using two antenna elements may further offer spatial diversity.

In some embodiments the dual polarised omnidirectional antenna apparatus further comprises a power source electrically connected to the dual polarised directional antennas, the power source being configured to power the dual polarised directional antennas in-phase. The power source may be a transceiver, or separate transmit or receive circuitry connected to the dual polarised directional antennas. Some embodiments may further comprise a signal processing capability.

A further advantage of using dual polarised directional antennas in accordance with the invention is that a further form of diversity is available—pattern diversity—between the antennas themselves. Each dual polarised antenna will point away from the platform in a different direction, and so will be affected differently by multipath or other interference effects. As such, if a comparator is used to compare the signals from each dual polarised antenna, antennas with poor performance can be identified and in some embodiments, optionally be precluded from transmitting or receiving.

The dual polarised omnidirectional antenna apparatus is intended to be mounted upon a platform, such that the directional antennas are arranged in a substantially equi-spaced distributed array around the platform. The platform may be a person, in which case the use of directional antenna elements is advantageous in respect of specific absorption ratio (SAR) of the antenna apparatus. Alternatively, in preferred embodiments the platform is a vehicle. For instance an omnidirectional antenna apparatus may be used on a car to assist with automated driving features such as collision avoidance. Omnidirectional performance on a vehicle may also be used for off-vehicle transmit and receive communications. The challenge when attempting to integrate antennas onto an electrically large platform (physically large with respect to wavelength) is that radiation patterns can easily begin to distort and shadowing effects can easily become prevalent—this is particularly acute where omnidirectional antennas are concerned. Having an antenna apparatus comprising at least two directional antennas configured to be mounted in a substantially equi-spaced distributed array around and pointing away from a vehicle, with the antenna apparatus configured such that, when operated in transmit, the directional antennas operate in phase with each other to deliver a combined omnidirectional performance, radiating purposely away from a vehicle, has been shown by the inventor to be an effective way of mitigating the distortive effects of the vehicle. Even more beneficial is the use of dual polarised directional antennas in such an antenna apparatus, to improve bandwidth and mitigate interference effects. In general the term 'mountable' is intended to encompass mounting on or within a garment of a user, or on or within the chassis/framework/bodywork of a vehicle. The dual polarised directional antennas may be secured with flaps and press studs, zip fasteners, clamps, bolts, or even in some instances welding or adhesive.

Preferred embodiments of the dual polarised omnidirectional antenna apparatus are configured to operate at 1800 MHz to 6000 MHz. Other embodiments operate at 800 MHz to 2500 MHz. The dual polarised directional antenna elements may be configured to provide such frequencies by virtue of using different planar antenna design topologies, or inclusion of parasitic radiators. For instance it has been shown in GB2539327 that a wideband directional antenna element can be manufactured by precisely configuring a PIFA type antenna.

According to a second aspect of the invention, there is provided a method of omnidirectional communication, the method comprising the steps of: providing the dual polarised omnidirectional antenna apparatus of the first aspect of the invention; mounting the dual polarised directional antennas of the antenna apparatus onto a platform as a substantially equi-spaced array around and pointing away from the platform; providing in-phase power to the dual polarised directional antennas; and then receiving a signal or transmitting a signal using the dual polarised omnidirectional antenna apparatus. This provides a user with a high gain omnidirectional antenna with improved bandwidth and interference mitigation, owing to the overlapping dual polarised radiation patterns.

BRIEF DESCRIPTION OF THE DRAWINGS

Embodiments of the invention will now be described by way of example only and with reference to the accompanying drawings, in which.

DETAILED DESCRIPTION

Figure 1:
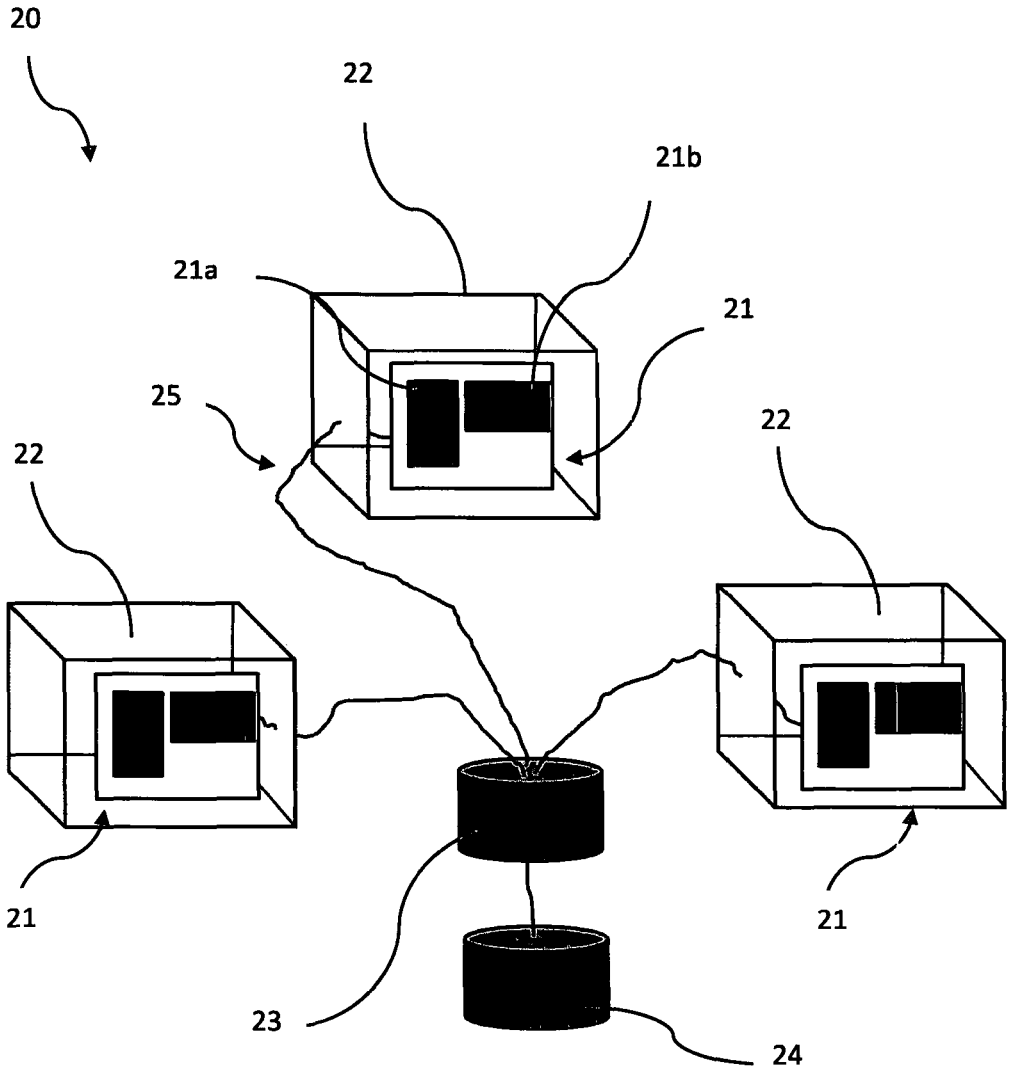
FIG. 1 shows an illustration of an embodiment of a dual polarised omnidirectional antenna apparatus.

FIG. 1 shows an illustration of a plurality of dual polarised directional antennas 21 configured as an embodiment of an omnidirectional antenna apparatus 20. Dual polarised directional antennas 21 are shown inside respective protective radomes 22 to protect against damage or abrasion. The radomes 22 are formed from plastic and are transparent to the radio frequencies of operation of antennas 21. Each antenna 21 is electrically connected (via wires 25) to a transmitter 23, itself being electrically connected to power supply 24. The power supply 24 is a portable battery unit (for instance lithium ion battery or other electrolyte based battery, such as would be found in a vehicle). The electrical connections 25 to each antenna 21 are split inside antenna 21 via respective power dividers (not shown) so as to power both antenna elements 21*a* and 21*b* in each antenna 21. The power divider inside each antenna 21 equally divides power to the respective first 21*a* and second 21*b* antenna elements, and applies zero degrees of phase shift. This ensures the first 21*a* and second 21*b* antenna elements in each dual polarised antenna 21 are operated in phase with each other, and that their radiation patterns are substantially uniform. The radiation patterns (vertical and horizontal polarisations, owing to the orthogonal orientations of antenna elements 21*a* and 21*b*) for all the dual polarised antennas 21 constructively combine (across the two polarisations) to provide overall dual polarised omnidirectional performance. The antenna elements 21*a* and 21*b* are arranged in the same geometrical plane so as to radiate in substantially the same direction.

Figure 2:
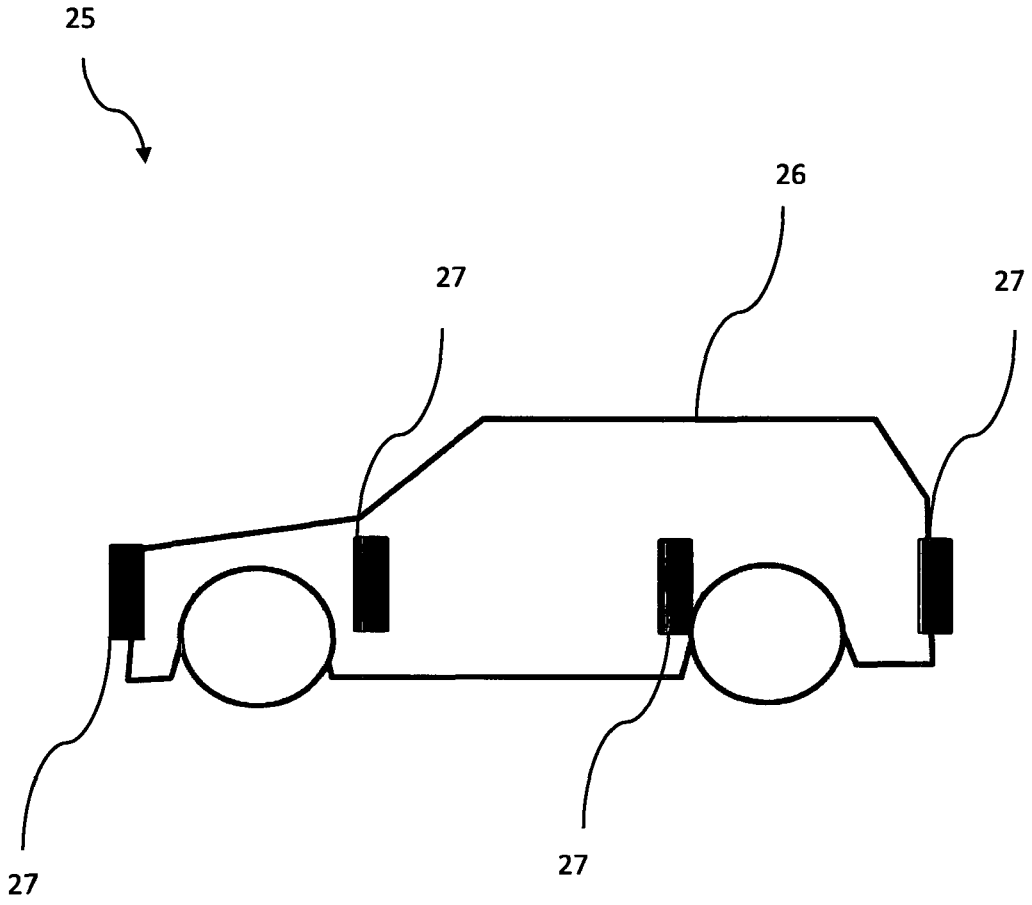
FIG. 2 shows an illustration of a dual polarised omnidirectional antenna apparatus mounted to a vehicle.

FIG. 2 shows an illustration of an embodiment of a dual polarised omnidirectional antenna apparatus 25 when mounted to a vehicle 26. Shown in the figure are a plurality of dual polarised antennas 27 mounted on the front, back, and sides of the vehicle (the far side is not shown in figure). The antennas 27 are operated in phase with each other to deliver a combined dual polarised omnidirectional performance radiating away from the vehicle 26.

Figure 3:
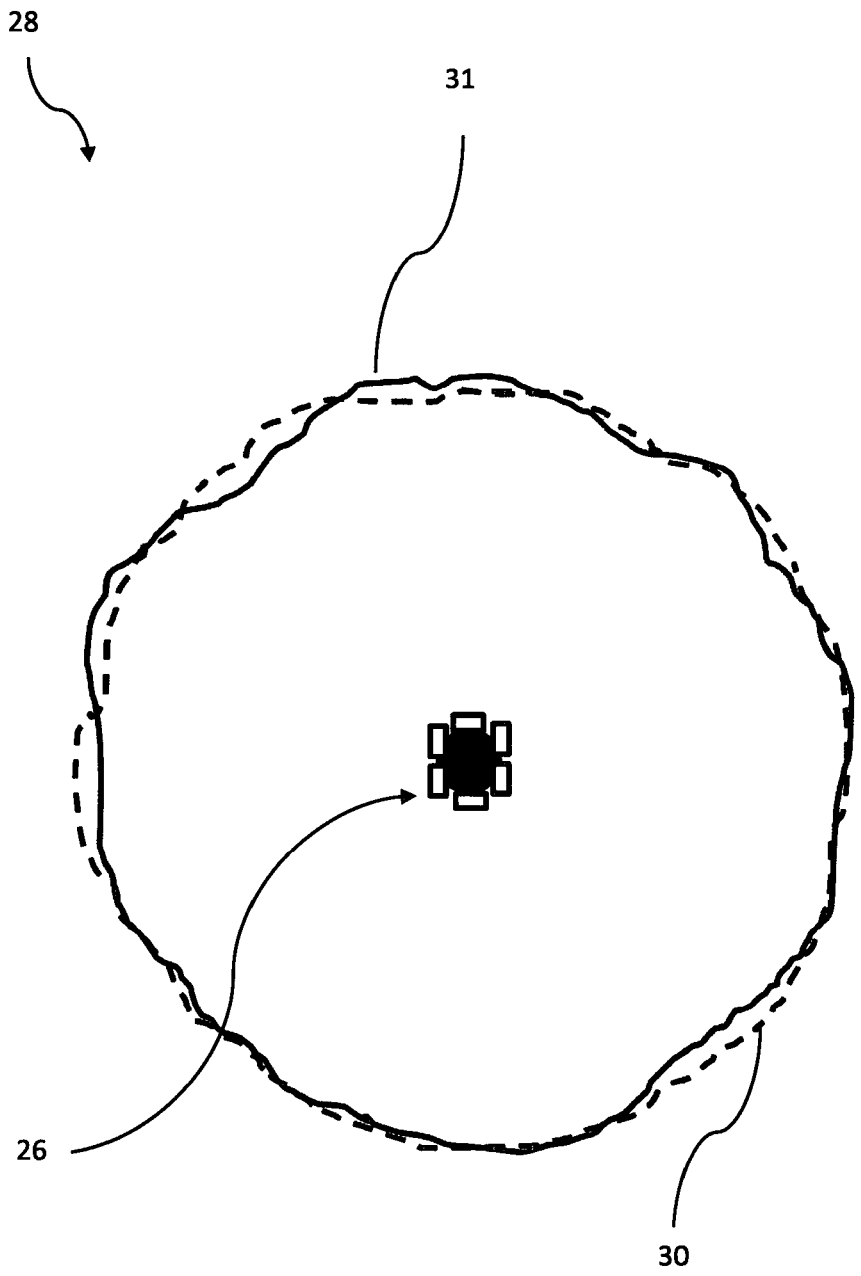
FIG. 3 shows an illustration of the gain profile of the embodiment of FIG. 2, showing overlapping dual polarised coverage.

FIG. 3 shows an illustration of the gain profiles 28 provided by the embodiment of FIG. 2. The figure shows vehicle 26 with a plurality of dual polarised directional antennas mounted thereupon. The dual polarised directional antennas are operated in phase with each other so as to provide an omnidirectional performance radiating away from the vehicle 26 with vertical polarisation 30. The dual polarised antennas simultaneously also provide an omnidirectional performance radiating away from the vehicle 26 with horizontal polarisation 31. The radial distance from the vehicle 26 is intended to illustrate gain (i.e. greater radial distances from the vehicle 26 indicate higher gain).

Whilst the embodiments described indicate dual polarisation being achieved by each antenna comprising two spatially orthogonal antenna elements, other embodiments may comprise spiral antennas that by virtue of being circularly polarised offer components of radiation with both vertical and horizontal polarisations. Such antenna elements may be provided in a cavity backed configuration to achieve the desired directionality.

The invention claimed is:

1. A dual polarised omnidirectional vehicle antenna apparatus capable of operating in transmit and receive, comprising at least two dual polarised directional antennas configured outwardly, the apparatus adapted to mount in a substantially equi-spaced distributed array around and pointing away from a vehicle, wherein the antenna apparatus is configured such that, when operated in transmit and/or receive, the dual polarised directional antennas operate in phase with each other to deliver a combined omnidirectional, dual polarised, performance.

2. The dual polarised omnidirectional vehicle antenna apparatus of claim 1, further comprising a power source electrically connected to the dual polarised directional antennas, the power source being configured to power the dual polarised directional antennas in-phase.

3. The dual polarised omnidirectional vehicle antenna apparatus of claim 1, further comprising a signal processor.

4. The dual polarised omnidirectional vehicle antenna apparatus of claim 1, configured to operate at 1800 MHz to 6000 MHz.

5. The dual polarised omnidirectional vehicle antenna apparatus of claim 1, configured to operate at 800 MHz to 2500 MHz.

6. A method of omnidirectional communication to or from a vehicle, the method comprising the steps of:

providing the dual polarised omnidirectional vehicle antenna apparatus of claim 1;

mounting the dual polarised directional antennas of the antenna apparatus onto a vehicle as a substantially equi-spaced array around and pointing away from the vehicle;

providing in-phase power to the dual polarised directional antennas; and receiving a signal or transmitting a signal using the dual polarised omnidirectional vehicle antenna apparatus.

7. A vehicle comprising the dual polarised omnidirectional vehicle antenna apparatus of claim 1.

8. The dual polarised omnidirectional vehicle antenna apparatus of claim 1, further comprising a platform from which the at least dual polarised directional antennas extend outwardly.

9. The dual polarised omnidirectional vehicle antenna apparatus of claim 8, wherein the apparatus is adapted to be mounted to the vehicle such that the platform is proximate to the vehicle and is adapted to be mounted on the vehicle.

10. The dual polarised omnidirectional vehicle antenna apparatus of claim 1, wherein each dual polarised directional antenna comprises a first element in a first polarisation and a second element in a second polarisation that is different from the first polarisation.

11. An omnidirectional vehicle antenna apparatus capable of operating in transmit and receive, comprising at least two directional antennas configured outwardly and adapted to mount in a substantially equi-spaced distributed array around and pointing away from a vehicle, wherein the antenna apparatus is configured such that, when operated in transmit and/or receive, the directional antennas operate: in phase with each other to deliver a combined omnidirectional performance.

12. The omnidirectional vehicle antenna apparatus of claim 11, further configured such that when operated in receive, the directional antennas operate in phase with each other to deliver a combined omnidirectional performance.

13. The omnidirectional vehicle antenna apparatus of claim 11, further comprising a power source electrically connected to the directional antennas, the power source being configured to power the directional antennas in-phase.

14. The omnidirectional vehicle antenna apparatus of claim 11, further comprising a signal processor.

15. The omnidirectional vehicle antenna apparatus of claim 11, configured to operate at 1800 MHz to 6000 MHz.

16. The omnidirectional vehicle antenna apparatus of claim 11, configured to operate at 800 MHz to 2500 MHz.

17. A vehicle comprising the omnidirectional vehicle antenna apparatus of claim 11.

18. An antenna array comprising a plurality of dual polarised directional antennas that are mounted around an exterior surface of a vehicle, wherein the antenna array is configured such that when operated in transmit and/or receive, the plurality of dual polarised directional antennas operate in phase with each other to deliver a combined omnidirectional dual polarised performance radiating away from the vehicle.

19. The antenna array of claim 18, wherein at least some of the plurality of dual polarised omnidirectional vehicle antennas are mounted substantially equi-spaced around the vehicle.

20. An antenna array comprising a plurality of directional antennas that are mounted substantially equi-spaced around and pointing away from a vehicle, wherein the antenna array is configured such that when operated in transmit and/or receive, the plurality of directional antennas operate in phase with each other to deliver a combined omnidirectional performance radiating away from the vehicle.

21. A vehicle comprising an antenna array, the antenna array comprising a plurality of dual polarised directional antennas that are mounted substantially equi-spaced around and pointing away from the vehicle, wherein the antenna array is configured such that when operated in transmit and/or receive, the plurality of dual polarised directional antennas operate in phase with each other to deliver a combined omnidirectional dual polarised performance radiating away from the vehicle.

* * * * *